United States Patent [19]

Bounds

[11] 4,082,230

[45] Apr. 4, 1978

[54] CHEESE GRATER AND CONTAINER

[76] Inventor: William E. Bounds, 23790 Hawthorne Blvd., Torrance, Calif. 90505

[21] Appl. No.: 786,607

[22] Filed: Apr. 11, 1977

[51] Int. Cl.[2] ..... A47J 43/25

[52] U.S. Cl. ..... 241/92; 241/169.1; 241/273.2

[58] Field of Search ..... 241/92, 168, 169, 169.1, 241/273.1, 273.2, 273.3

[56] References Cited

U.S. PATENT DOCUMENTS

| | | | |
|---|---|---|---|
| 247,503 | 9/1881 | Laha | 241/169.1 |
| 2,022,151 | 11/1935 | Riddle | 241/273.3 X |
| 2,867,255 | 1/1959 | Berney et al. | 241/273.2 |
| 3,552,460 | 1/1971 | Cooney | 241/169.1 |
| 3,581,790 | 6/1971 | Del Conte | 241/169.1 X |
| 3,642,045 | 2/1972 | Duvelot | 241/169.1 |

*Primary Examiner*—Roy Lake
*Assistant Examiner*—Howard N. Goldberg
*Attorney, Agent, or Firm*—Edward A. Sokolski

[57] ABSTRACT

A base member which may be cylindrical in form has a central post extending therefrom. Surrounding the central post is a tray having a ring running around its edge which forms a perimeter for the tray. Extending up from the tray are a plurality of spikes on which cheese is impaled and thus held in position on the tray. A cylindrical cover member is preferably made of clear plastic. The cover member has a central post having an aperture therein, the central post of the base member fitting into the aperture of the central post of the cover member. The cover member has a cylindrical side wall and a top wall, the free edges of the side wall resting on the tray, thus forming a cover over the tray for the cheese. Supported on the top wall of the cover is a disc-shaped grater member having scoop-shaped cutter blades which are arranged in a plurality of interleaved spirals. Grating is accomplished by removing the cover member from the post and placing it upside down on the post with the grater placed against the top surface of the cheese for rotary grating action.

8 Claims, 5 Drawing Figures

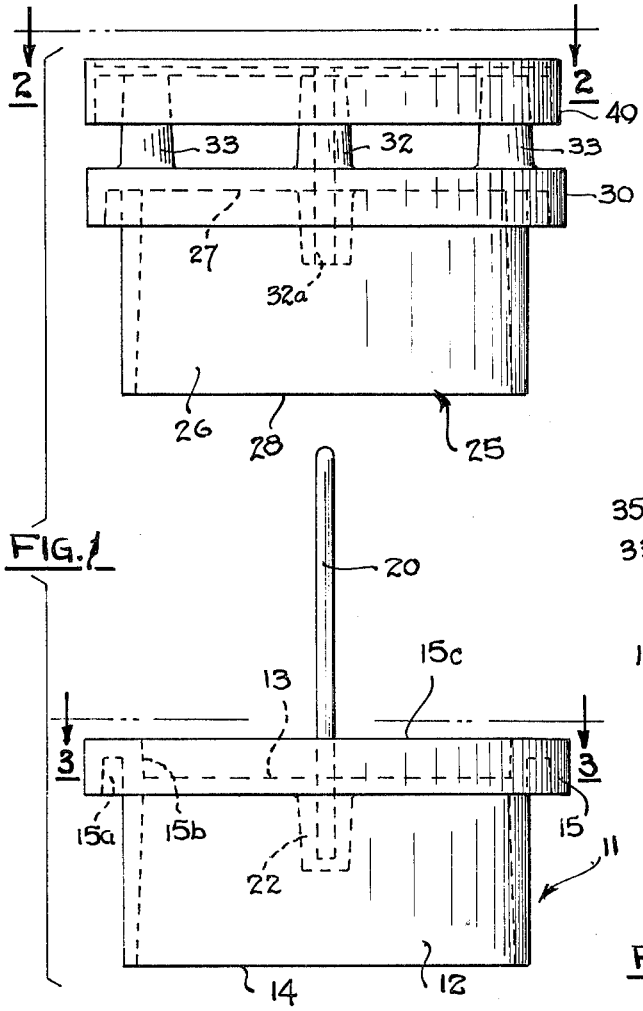
FIG. 1
FIG. 2
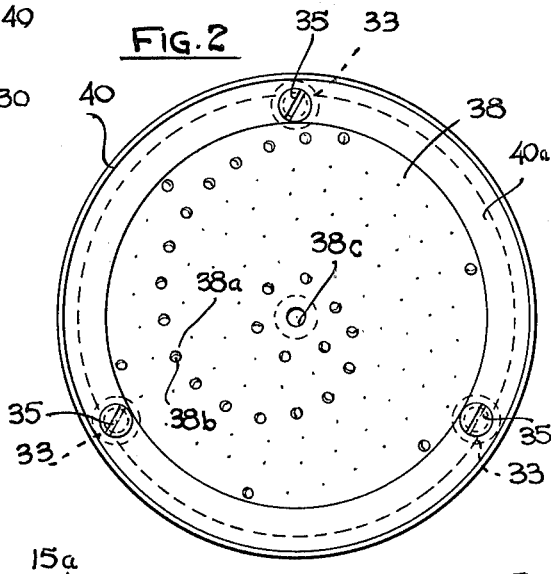
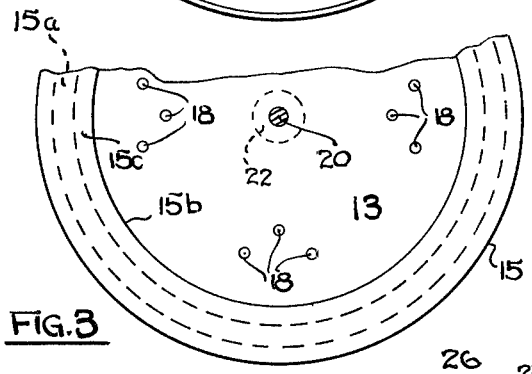
FIG. 3
FIG. 4
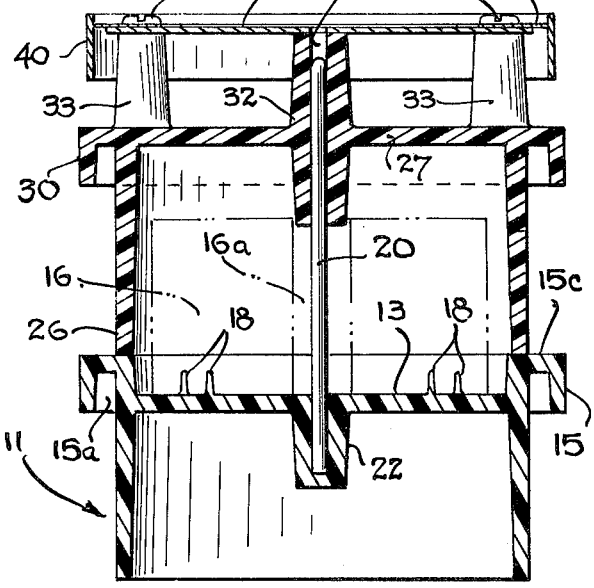
FIG. 5
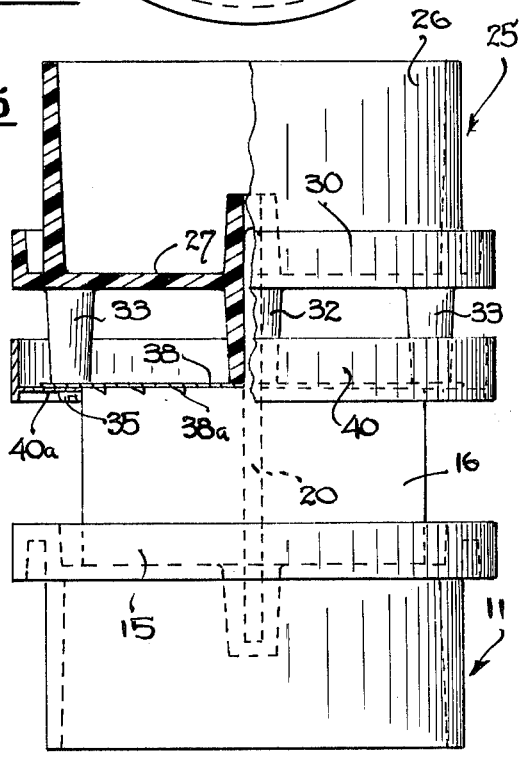

CHEESE GRATER AND CONTAINER

This invention relates to a cheese grater and container, and more particularly to such a device employing rotary grating action.

Most prior art cheese graters are operated with a reciprocating linear motion with one hand while the cheese is held in place with the other. This type of device has several shortcomings. First, the operator's hand is exposed to the grater which presents the hazard of being cut. Further, the operator must handle the cheese, which is undesirable in the case of cheeses having strong odors and from the point of view of sanitation. Handle operated rotary cheese graters have been developed to overcome these shortcomings, but these devices generally are rather bulky and expensive in their construction and unsuitable for placement on the dinner table for operation by each individual user.

The device of the present invention overcomes the aforementioned shortcomings of the prior art in providing a combination cheese grater and container suitable for placement on the dinner table for operation by the end user of the cheese. Means are provided in the present invention for holding the cheese in such a manner that one's fingers need not be placed on the cheese. Further, the device of the invention provides a see-through container for the cheese which encloses it completely yet provides full view thereof.

It is therefore an object of this invention to provide an improved combination cheese grater and container which is suitable for use at the dinner table.

It is a further object of this invention to provide an improved cheese grater and container of simple and economical construction, in which the need for handling of the cheese by the operator is avoided.

Other objects of the invention will become apparent as the description proceeds in connection with the accompanying drawings, of which:

FIG. 1 is an exploded elevational view of a preferred embodiment of the invention;

FIG. 2 is a top plan view taken along the plane indicated by 2—2 in FIG. 1;

FIG. 3 is a view taken along the plane indicated by 3—3 in FIG. 1;

FIG. 4 is a side elevational view in cross section showing the preferred embodiment in position for containing cheese; and FIG. 5 is a side elevational view of the preferred embodiment in partial section showing the device in position for grating the cheese.

Briefly described, my invention is as follows: A base member has a side wall forming a stand which is preferably cylindrical in configuration and a top wall forming a tray for the cheese. This top wall has a plurality of spikes extending therefrom for impaling the cheese so as to hold it in position during the grating operation. A perimeter is formed for this tray by a ring-shaped wall membe which extends upwardly therefrom. A central post extends upwardly from the tray. A cover member provides a cover for the cheese at times other than when it is being grated. The cover member preferably has a cylindrical side wall which fits over the tray of the base member and a top wall. A central post member extends from each of the opposite surfaces of the top wall, these post members having an aperture extending therethrough. Mounted on the top wall of the cover member is a disc-shaped grater plate with scoop-shaped blades which are arranged in a plurality of interleaving spirals. In the cheese storage position, the central post of the base member fits through the aperture in the central post of the cover member, with the side wall of the cover member resting on the tray, the cover member and the tray thereby forming a container for the cheese. In the grating position, the cover member is turned upside down from the storage position with the grater plate abutting against the cheese and the central post of the base member fitted through the aperture in the central post of the cover member. The cover member thus can be rotated on the post of the base member so that the grater grates the cheese.

Referring now to FIGS. 1, 2, 3 and 4, a preferred embodiment of the device of the invention is illustrated. Base member 11 has a cylindrical side wall 12, and a circular top wall 13, leaving an open circular bottom 14. Running around the top edge of side wall 12 is a ring 15 which has a groove 15*a* formed therein and a top circular surface 15*c*. Ring 15 extends outwardly from side wall 12 and has an inner circular surface 15*b* which with top wall 13 forms a tray on which the cheese 16 is placed, as shown in FIG. 4. Extending upwardly from top wall 13 are a plurality of spikes 18 on which the cheese is impaled and prevented from rotating during the grating operation.

Supported at the center of top wall 13 by means of retainer 22, which is formed in the wall and extends downwardly therefrom, is central post 20. Post 20 may be force fitted in retainer 22 or may be cemented thereto. Cover member 25 has a cylindrical side wall 26 and a circular top wall 27, the bottom portion 28 of the cover being open. A ring 30 runs around top wall 27 and forms a circular lip opposite side wall 26. Mounted in the center of top wall 27 and extending substantially perpendicularly from the top and bottom surfaces of this wall is a center post 32 which has an aperture 32*a* extending therethrough. Extending from top wall 27 are three posts 33. Supported on posts 33, as best shown in FIG. 2, by means of screws 35, is grater plate 38. Also supported on posts 33 by means of screws 35 is ring member 40 which provides a guard around the edges of the grater. It is to be noted that ring member 40 has flanges 40*a* which are held under screws 35.

Grater plate 38 has cutter blades 38*a* formed therein, these blades being in the general shape of scoops, with apertures 38*b* being formed in the plate adjacent to each blade. The blades are arranged to form a plurality of interleaving spirals as shown in FIG. 2, this to provide uniform cutting action over the surface of the cheese with rotation of the grater plate. Grater plate 38 has an aperture 38*c* at its center which is aligned with aperture 32*a* of post 32. The main bodies of base 11 and cover member 25 may be molded from plastic. Preferably a clear plastic is employed at least for cover member 25 so as to provide visibility of the cheese when the cover plate is in the storing position as shown in FIG. 4.

Referring now to FIG. 4, the device is shown in the "storing" position with a piece of cheese 16 on the tray formed by the top wall of base member 11. The cheese as can be seen has a hole 16*a* formed in the center thereof which has a diameter substantially larger than that of post 20, so that it can be placed over post 20. For optimum use of the cheese it is preferably made in cylindrical form. Placed over the cheese to form a container therefor is cover member 25, central post 20 of the base member fitting within the aperture 32*a* of the cover member central post 32. Thus, in the "stored" position, the cheese is fully covered with a clear plastic cover member in full view.

Referring now to FIG. 5, the device is shown in the "grating" position. This position is reached merely by lifting cover member 25 off post 20 and reversing its position with grater plate 38 now resting on the top surface of cheese 16. The cheese, as already noted, is held in position by spikes 18 so that when grater plate 38 is rotated by manual movement of cover member 25, the cheese will be grated. It is to be noted that continuous one-way rotation of cover member 25 results in long strings of cheese, while reciprocal rotary motion of the cover member results in small bits of cheese. It is further to be noted that the spirally arranged interleaved cutting blades assures a uniform cutting of the surface of the cheese. As can be seen, the device can be held (with post 20 in a generally horizontal orientation) over the food to which cheese is to be applied, and as the grating action is accomplished, the cheese will fall directly on the food from the blades.

While the invention has been described and illustrated in detail, it is to be clearly understood that this is intended by way of illustration and example only and is not to be taken by way of limitation, the spirit and scope of this invention being limited only by the terms of the following claims.

I claim:

1. A cheese grater and storage container for use in grating a piece of cheese in a cheese grating position and storing said piece of cheese in a cheese storage position, comprising:

a base member having a side wall forming a stand, a top wall forming a tray for the piece of cheese, the top wall having means thereon for holding the piece of cheese against rotation during the grating operation, and a central post extending upwardly from the top wall normal to the surface thereof, and a cover member having a side wall adapted to fit over the base member tray, a top wall, a central post extending normally from each of the opposite broad surfaces of said top wall of the cover member, said central posts having apertures formed therein along the longitudinal axes thereof, a grater plate and means for supporting said grater plate on said top wall of the cover member in spaced relationship therewith and substantially parallel thereto, said cover member fitting on said base member with the side wall of the cover member resting on the base member and the central post of the base member fitted in the aperture of one of the central posts of the cover member, thereby forming a container for the piece of cheese in the cheese storage position, said cover member fitting on said base member with the central post of the base member fitted in the aperture of the other of the central posts of the cover member with the grater abutting against the piece of cheese in the cheese grating position.

2. The device as recited in claim 1 wherein said base and cover members are cylindrical in shape and said grater is in the shape of a disc-shaped plate.

3. The device as recited in claim 2 and further including a ring member extending around the edges of said grater plate to provide a guard around said edges.

4. The device as recited in claim 2 wherein said grater has blades arranged in a plurality of interleaved spirals.

5. The device as recited in claim 4 wherein said blades are scoop-shaped.

6. The device as recited in claim 1 wherein the means for supporting said grater plate comprises a plurality of support posts extending upwardly from the top wall of the cover member and means for attaching the grater plate to said support posts.

7. The device as recited in claim 1 wherein the top wall means for holding the piece of cheese comprises a plurality of spikes extending upwardly from said top wall for impaling the cheese.

8. The device as recited in claim 1 wherein said base member additionally has a ring running around the top wall of the base member to form a perimeter for said tray.

* * * * *